US008721375B2

(12) United States Patent
Hori

(10) Patent No.: US 8,721,375 B2
(45) Date of Patent: May 13, 2014

(54) CONNECTOR

(75) Inventor: Takayuki Hori, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/526,615

(22) Filed: Jun. 19, 2012

(65) Prior Publication Data

US 2012/0328359 A1 Dec. 27, 2012

(30) Foreign Application Priority Data

Jun. 20, 2011 (JP) ..... 2011-136816

(51) Int. Cl.
*H01R 13/514* (2006.01)

(52) U.S. Cl.
USPC ..... 439/752

(58) Field of Classification Search
USPC ..... 439/752, 595, 744, 871
See application file for complete search history.

(56) References Cited

U.S. PATENT DOCUMENTS

2007/0281555 A1* 12/2007 Suemitsu et al. ..... 439/752

* cited by examiner

*Primary Examiner* — Neil Abrams
*Assistant Examiner* — Phuongchi T Nguyen
(74) *Attorney, Agent, or Firm* — Clarence R. Moon

(57) ABSTRACT

The connector of the present invention is provided with a cover member attached to an enclosure main body and has a plurality of terminal holes formed, wherein the cover member has engagement piece that is attached to the edge of an opening of a holding hole where a holding member is inserted.

5 Claims, 8 Drawing Sheets

CONNECTOR

RELATED APPLICATIONS

This application claims priority to Japanese Application No. 2011-136816, filed Jun. 20, 2011, which is incorporated herein by reference in its entirety.

TECHNICAL FIELD

The present invention relates to a connector and specifically to a structure of an enclosure.

BACKGROUND ART

Patent Document 1 discloses a connector provided with an enclosure main body that holds a plurality of terminals, a cover member that attaches to the enclosure main body, and a holding member for raising the holding force of the terminal.

Patent Document 1] Japanese Unexamined Patent Application No. H5-347167

SUMMARY OF THE INVENTION

However, miniaturizing a connector according to the conventional art given above is difficult because an engagement part for the cover member to engage and a holding hole where the holding member is inserted must be formed respectively on the enclosure main body. In addition, when simply miniaturizing the connector, there is a risk of not being able to secure a sufficient holding force because the structure that generates the holding force of the terminal is reduced.

A primary objective of the present invention in consideration of the situation given above is to provide a connector that can be minimized while improving the holding force of a terminal.

In order to resolve the problem described above, the connector of the present invention is provided with an enclosure main body, a holding member, and a cover member. The enclosure main body is formed to have a plurality of terminal holes that pass through in one direction and where a terminal is inserted from one side, and to have holding holes that have an opening on the side surface relative to the one direction, that extend in a direction that intersects with the one direction from the opening, and communicates with the plurality of terminal holes. The holding member is inserted into the holding hole and engages with the plurality of terminals that are inserted into the plurality of terminal holes. The cover member is attached to the other side of the one direction of the enclosure main body, and a plurality of terminal holes is formed to accommodate the plurality of terminal holes. The cover member has an engagement piece attached to the edge of the opening of the holding hole.

According to the present invention, the holding hole where the holding member is inserted is also used for the engagement of the cover member, and therefore, miniaturization of the connector can be devised. In addition, according to the engagement piece of the cover member, because the release of the holding member is suppressed, the holding force of the terminal can be improved.

In addition, in one configuration of the present invention, the holding member has a recessed part that corresponds to the engagement piece of the cover member. Accordingly, because the engagement piece of the cover member is inserted into the recessed part of the holding member, unevenness of the top surface of the connector can be suppressed.

In addition, in one configuration of the present invention, the holding member has a pressed part that extends in a direction separating from the engagement piece of the cover member. Accordingly, the holding member can be easily pressed.

In addition, in one configuration of the present invention, the cover member further has a plurality of engagement pieces that engage with a plurality of engagement pieces provided on the enclosure main body. Accordingly, engagement of the cover member to the enclosure main body can be stronger.

In addition, in one configuration of the present invention, the enclosure main body has a plurality of engagement pieces that engage with the terminals provided on the other side of the one direction and which are inserted into each terminal hole. Accordingly, the holding force of the terminal can be further improved.

DETAILED DESCRIPTION OF THE PREFERRED EMBODIMENTS

A description will be given of an embodiment of the connector of the present invention with reference to drawings.

Figure 1A:
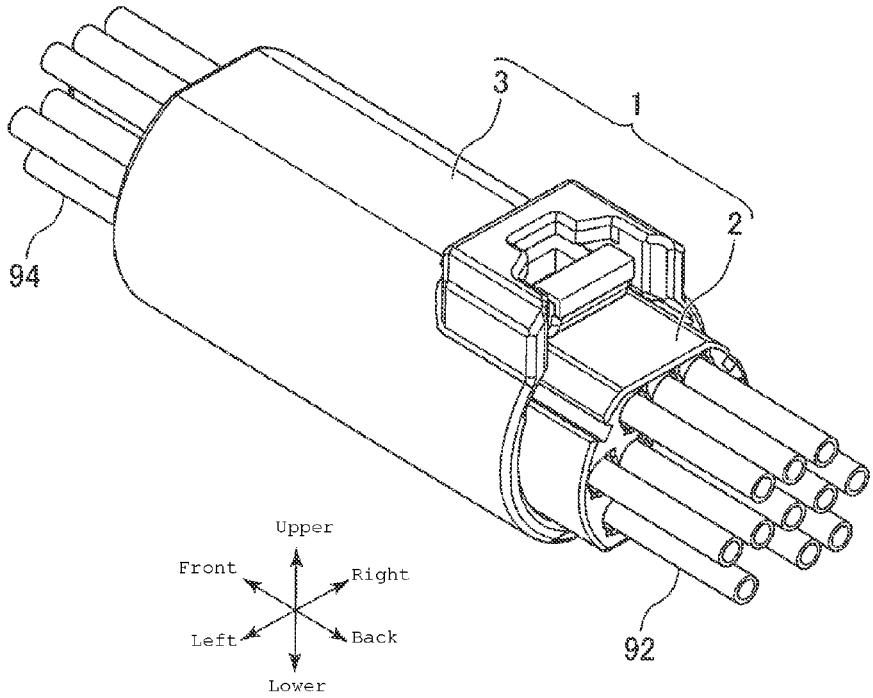
FIG. 1A is a perspective view a connector according to one embodiment of the present invention.
Figure 1B:
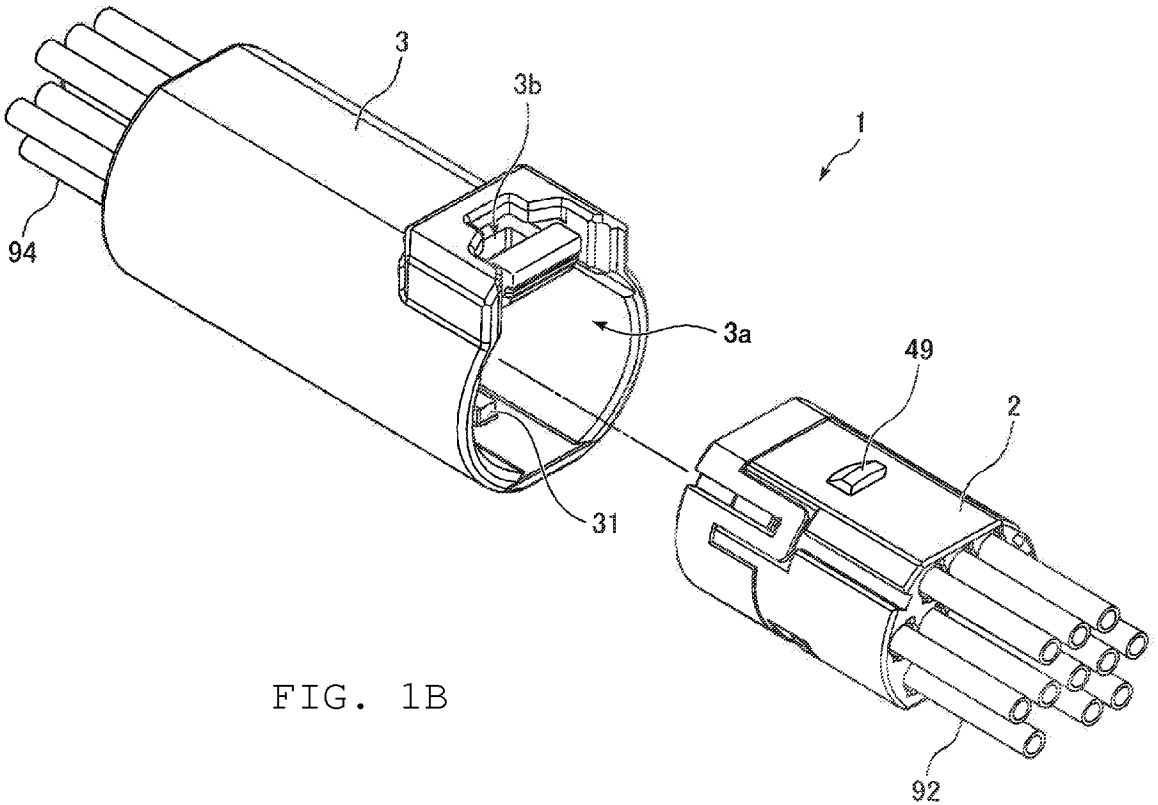
FIG. 1B is a blown up perspective view of a connector.
Figure 2A:
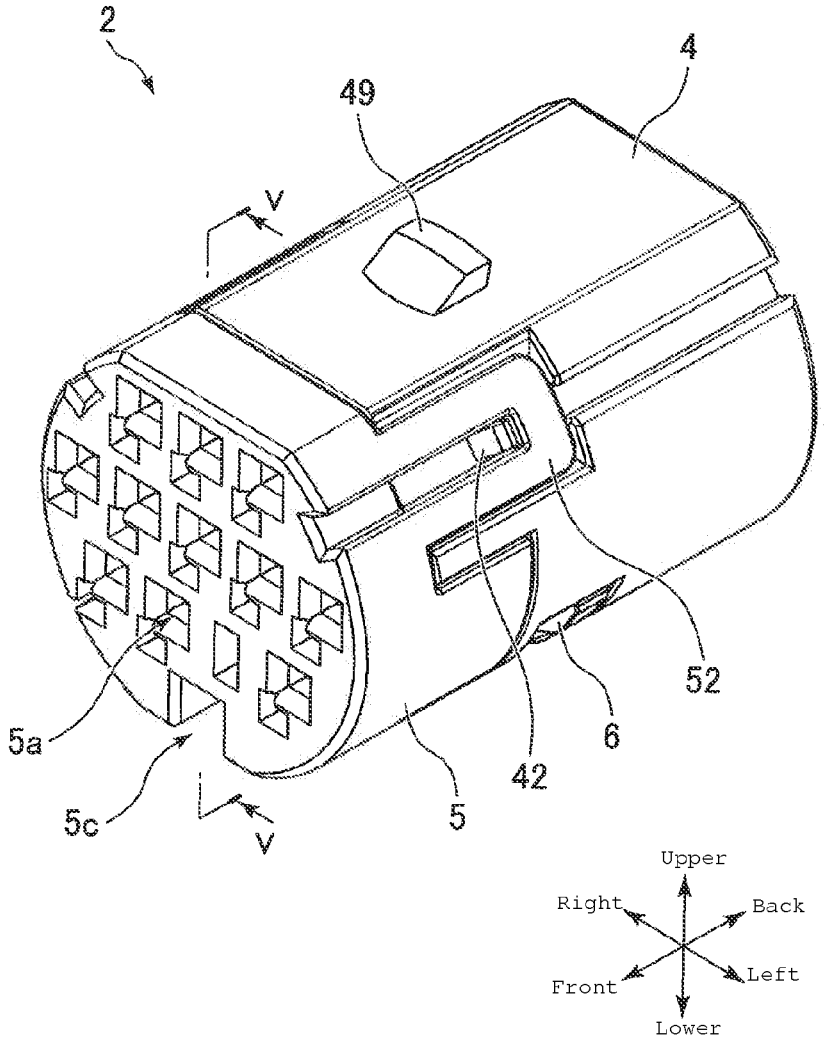
FIG. 2A is a perspective view a first connector included in the connector.
Figure 2B:
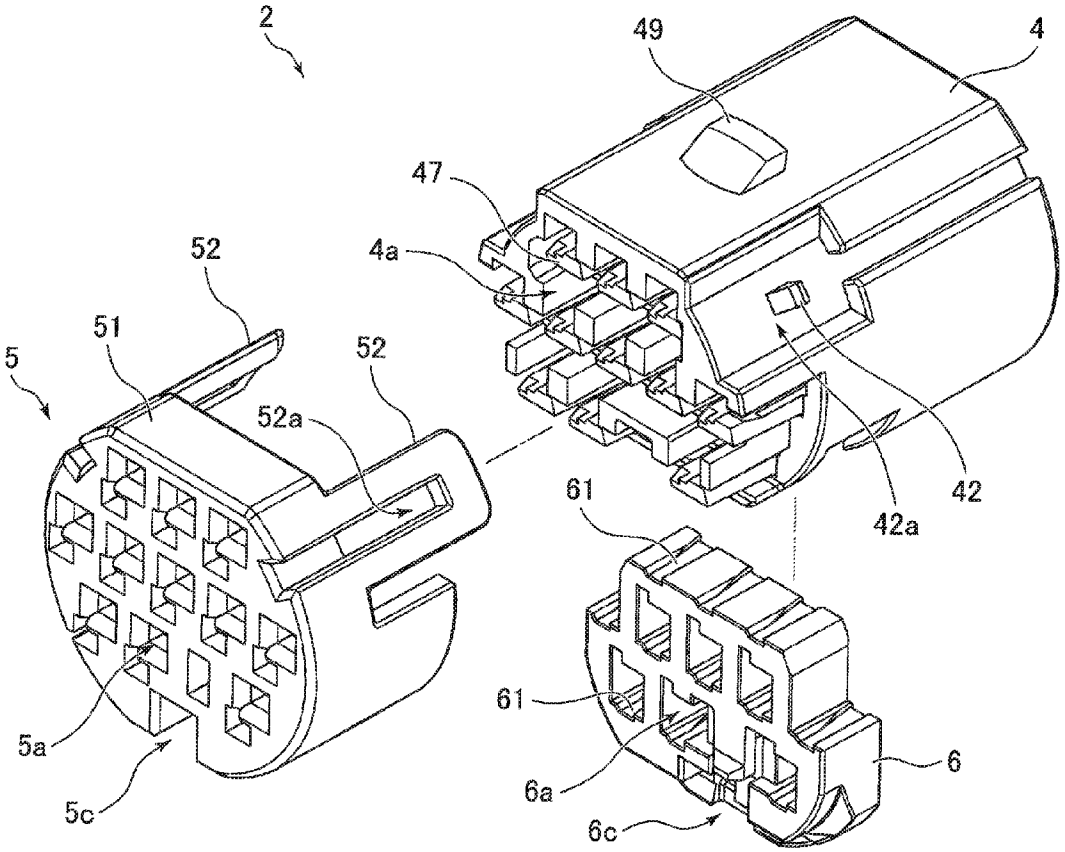
FIG. 2B is a blown up perspective view of the first connector.
Figure 3A:
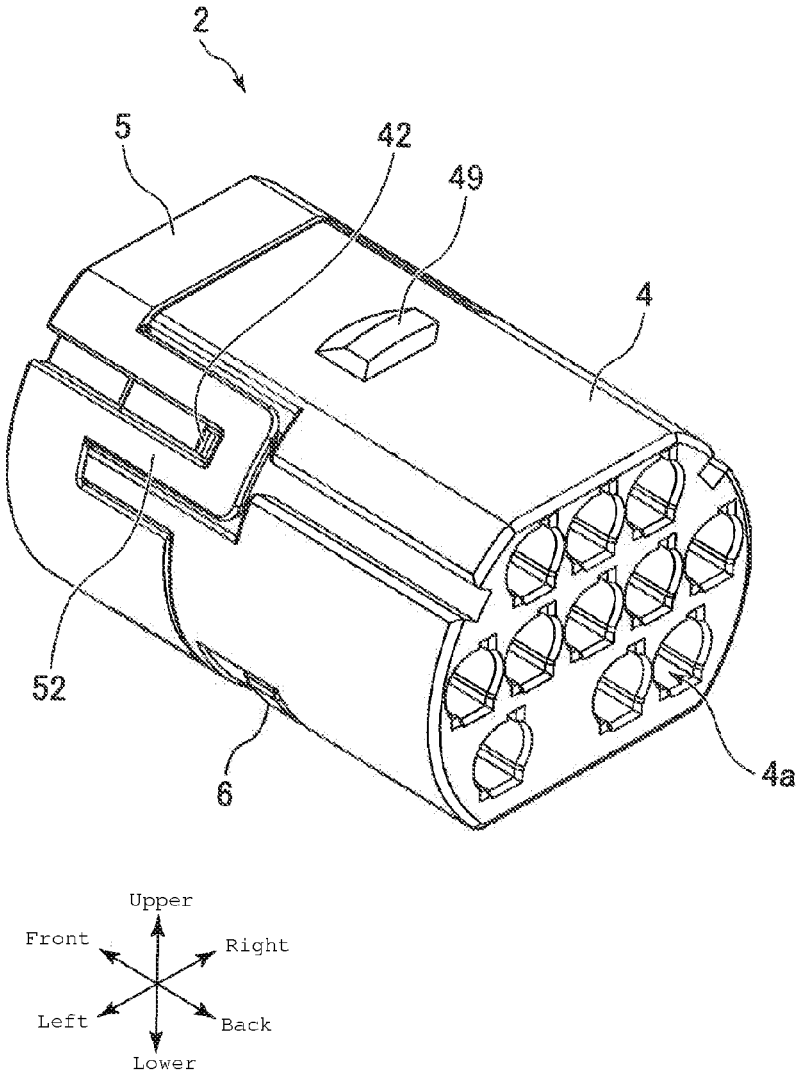
FIG. 3A is a perspective view of the first connector.
Figure 3B:
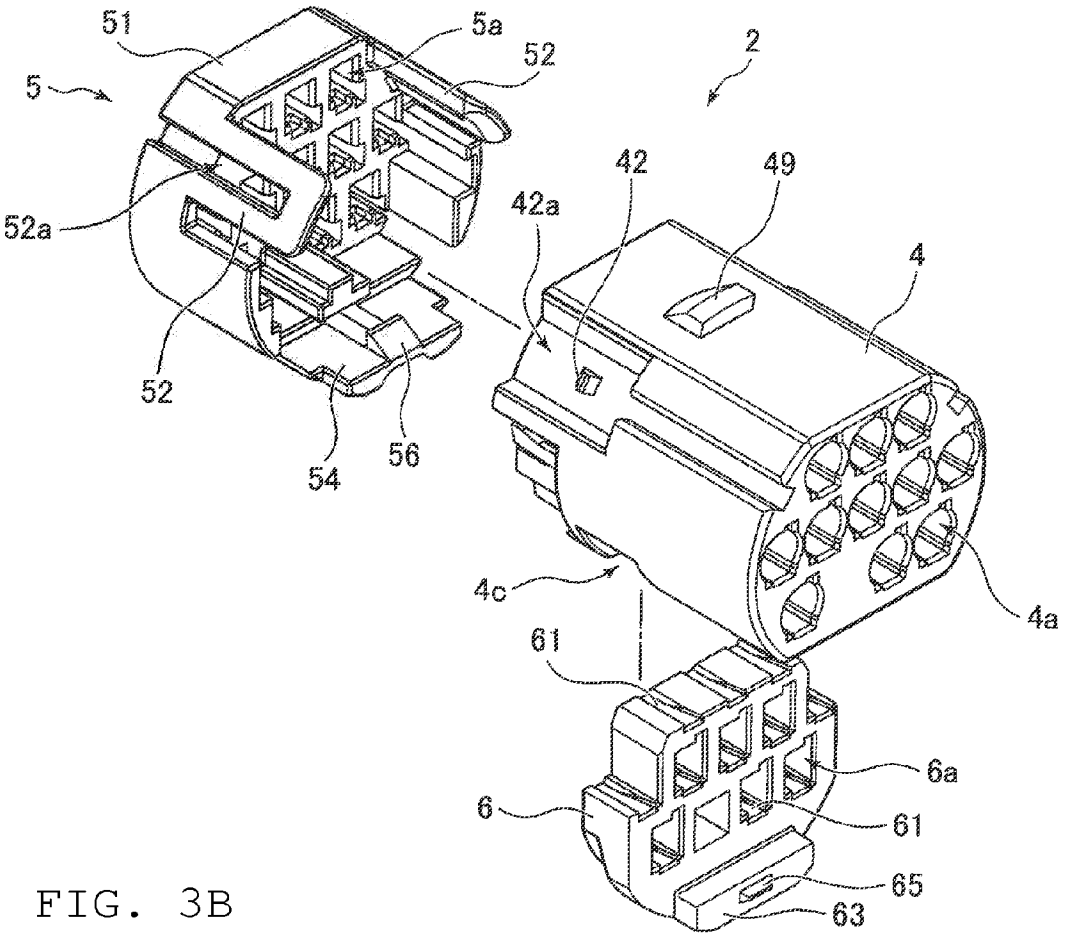
FIG. 3B is a blown up perspective view of the first connector.
Figure 4:
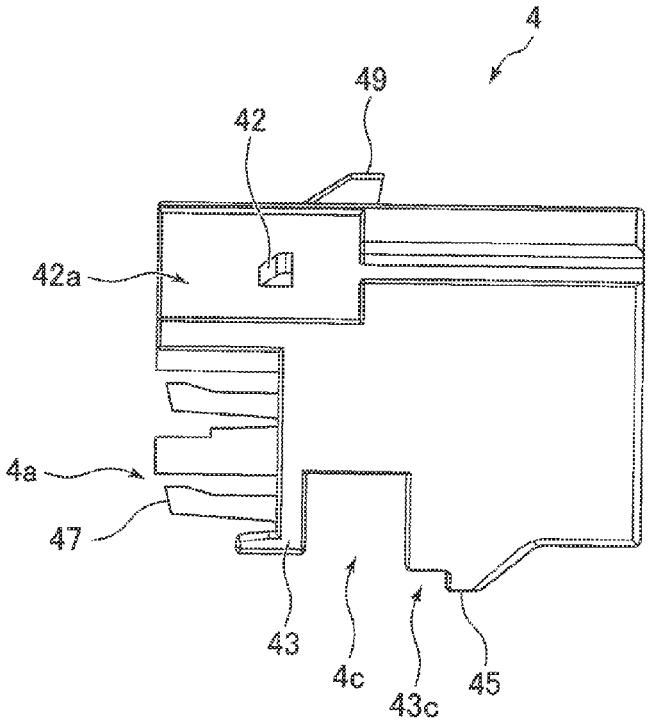
FIG. 4 is a side view of an enclosure main body included in the first connector.
Figure 5:
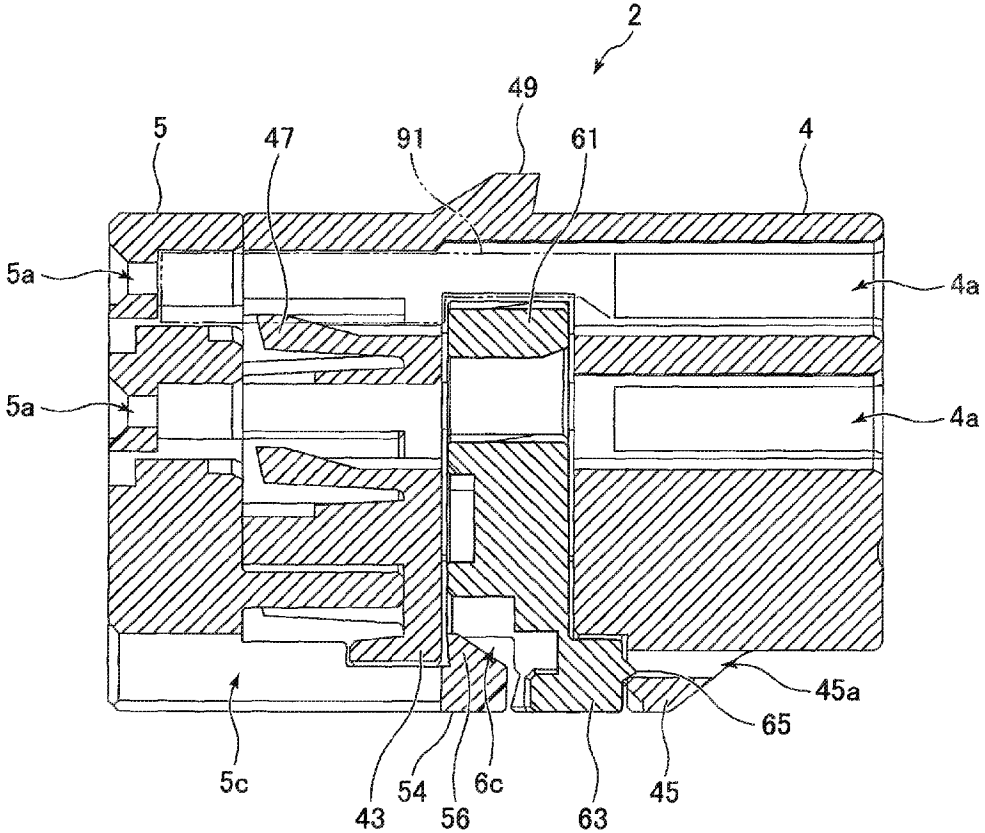
FIG. 5 is a cross-sectional view of the first connector.

FIGS. 1A and 1B are perspective views of a connector 1. FIGS. 2A and 2B are perspective views a first connector 2 included in connector 1. FIGS. 3A and 3B are perspective views from a different angle of the first connector 2. FIG. 4 is a side view of an enclosure main body 4 included in the first connector 2. FIG. 5 is a cross-sectional view of the first connector 2. In these figures, the insertion direction of the first connector 2 relative to the second connector 3 is the front direction, and of the enclosure main body 4 of the first connector 2, the direction where the engagement part 49 is provided is the upward direction.

As illustrated in FIGS. 1A and 1B, connector 1 is provided with a first connector 2 having a substantial pillar shape where a plurality of cables 92 is connected, and with a second connector 3 having a substantially cylindrical shape where a plurality of cables 94 is connected. The second connector 3 has an insertion hole 3*a* that opens facing rearward where the first connector 2 is inserted. An engagement hole 3*b* that engages with the engagement piece 49 of the first connector 2 is formed on the upper part of the side wall of the second connector 3. In addition, a rail part 31 that extends in the front and back direction is provided on the lower part of the inner side surface of the second connector 3.

As illustrated in FIGS. 2A to 3B, the first connector 2 is provided with an enclosure main body 4 having a substantial pillar shape, a cover member 5 attached to the front part of the enclosure main body 4, and a holding member 6 to prevent release of the terminal 91 (see FIG. 5). These enclosure main body 4, cover member 5, and holding member 6 are molded by an insulating resin material.

A plurality of terminal holes 4*a* that pass through in the front and back direction and which is the axial direction, is formed on the enclosure main body 4. Terminals 91 (see FIG. 5) are inserted from the rear into these terminal holes 4*a*. In addition, holding holes 4*c* that have an opening in the lower part of the side surface and that extend upward from the opening are formed on the enclosure main body 4. The holding hole 4*c* communicates with the plurality of terminal holes 4*a*. The holding hole 4*c* is formed in the central part of the front and back direction of the enclosure main body 4 and has a shape that is wide in the lateral direction.

A groove 42*a* that extends rearward from the front end is formed on both the left and right side of the upper part of the enclosure main body 4. An engagement piece 42 that protrudes in the outside direction is provided on the inner side of the groups 42*a*. In addition, engagement part 47 that juts out upward according to the direction forward is provided below each of the terminal holes 4*a* (see FIGS. 4 and 5).

The cover member 5 is provided with a disk part 51 in a substantial disk shape having a plurality of terminal holes 5*a* formed to pass through in the front and back direction, and two engagement pieces 52 that extends rearward from both the left and right sides of the upper part of the edge of the disk part 51, and a jaw part 54 that extends rearward from the lower part of the edge of the disk part 51. The plurality of terminal holes 5*a* correspond to the plurality of terminal holes 4*a* formed on the enclosure main body 4. Specifically, each of the terminal holes 5*a* are arranged so that each of the terminal holes 4*a* formed on the enclosure main body 4 communicate in the front and back direction when the cover member 5 is attached to the enclosure main body 4.

A groove 52*a* that extends in the front and back direction with the rear end closed is formed on each of the engagement pieces 52. These engagement pieces 52 engage with the engagement pieces 42 provided on the enclosure main body 4. Specifically, the engagement pieces 52 of the cover member 5 are inserted into the grooves 42*a* of the enclosure main body 4, and the engagement pieces 42 provided in the grooves 42*a* are inserted into the grooves 52*a* provided on the engagement pieces 52.

An engagement piece 56 that protrudes to the inner side direction is provided on the tip end part of the jaw part 54. The engagement piece 56 engages the holding hole 4*c* formed on the enclosure main body 4 (to be described in detail hereinafter). In addition, a slit 5*c* that extends rearward from the front and is formed on the jaw part 54. A rail part 31 provided on the inner side surface of the second connector 3 is inserted into the slip 5*c*.

The total of three engagement parts 52 and 56 provided on the edge of the disk part 51 are each arranged at an approximate 120° angle with the center of the disk part 51 as reference. Therefore, the cover member 5 can be stably fixed to the enclosure main body 4.

The holding member 6 is formed in a nearly plate like shape and is inserted from the bottom in the upward direction into the holding hole 4*c* formed on the enclosure main body 4. The holding member 6 has a plurality of engagement parts 61 on the upper surface thereof and on the lower surface of the terminal holding 6*a* that passes through in the front and back direction. Each of the engagement parts 61 correspond to the plurality of terminal holes 4*a* formed on the enclosure main body 4. A pressed part 63 that juts out rearward is provided on the lower end part of the holding member 6. The engagement piece 65 that protrudes rearward is provided on the back surface of the pressed part 63. In addition, a recessed part 6*c* is formed on the front side of the lower end part of the holding member 6.

As illustrated in FIG. 5, when the holding member 6 is inserted into the holding hole 4*c* of the enclosure main body 4, each of the engagement parts 61 of the holding member 6 juts out farther than the lower surface of each of the terminal holes 4*a* formed on the enclosure main body 4 and engage in a recessed part formed on a base end part of the terminals 91 inserted into each of the terminal holes 4*a*. By this, the release of the terminals 91 from the terminal hole 4*a* is suppressed. In addition, the engagement piece 47 provided on the front end part of the enclosure main body 4 engages with the tip end part of the terminals 91 inserted into each of the terminal holes 4*a*. Thereby, the release of the terminals 91 from the terminal hole 4*a* is suppressed.

The engagement piece 56 provided on the jaw part 54 of the cover member 5 is attached to the edge part 43 of the front end of the opening of the holding hole 4*c* where the holding member 6 is inserted. In other words, the engagement piece 56 is inserted near the opening of the holding hole 4*c* to contact or to oppose the back surface of the edge part 43 of the front end. At this time, the engagement piece 56 is inserted into the recessed part 6*c* formed on the lower end part of the holding member 6.

The cover member 5 is attached to the front part of the enclosure main body 4 by the two engagement pieces 52 provided on the upper part engaging with the two engagement pieces 42 of the side surface of the enclosure main body 4 after the engagement piece 56 provided on the lower part is attached to the edge part 43 of the opening of the holding hole 4*c* (conversely, the opposite sequence may also be used).

The pressed part 63 of the holding member 6 extends rearward so as to separate from the jaw part 54 of the cover member 5 and is inserted into the recessed part 43*c* (see FIG. 4) formed rearward of the opening of the holding hole 4*c*. The engagement piece 65 provided on the back surface of the pressed part 63 engages with the engagement hole 45*a* formed on the raised part 45 rearward of the recessed part 43*c*.

Although a description was given above for an embodiment of the present invention, the present invention is not limited to the embodiment described above, and various modified embodiments are of course possible by a person skilled in the art.

What is claimed is:

1. A connector, comprising:

an enclosure main body having a rear side and a front side, the enclosure main body having a plurality of terminal holes that pass through in one direction from the rear side to the front side of the enclosure main body and where a terminal is inserted from the rear side, and having holding holes that include an opening on a side surface relative to the one direction, and extending in a direction that intersects with the one direction from the opening, and communicates with the terminal holes;

a holding member inserted into the holding hole that engages the plurality of terminals inserted into the plurality of terminal holes; and a cover member attached to the front side of the enclosure main body in a direction opposite the one direction and having a plurality of terminal holes formed therein that correspond to the terminal holes, wherein the cover member has an engagement piece that engages the edge of the opening of the holding hole.

2. The connector according to claim 1, wherein the holding member has a recessed part that corresponds to the engagement piece of the cover member.

3. The connector according to claim 1, wherein the holding member has a pressed part that extends in a rearward direction separating the pressed part from the engagement piece of the cover member.

4. The connector according to claim 1, wherein the cover member comprises a plurality of engagement pieces that engage a plurality of engagement pieces provided on the enclosure main body.

5. The connector according to claim 1, wherein a plurality of engagement pieces are provided on a front end part of the enclosure main body that engage the terminals inserted into each terminal hole.

* * * * *